US005122198A

United States Patent [19]

von Hagen et al.

[11] Patent Number: 5,122,198

[45] Date of Patent: Jun. 16, 1992

[54] METHOD OF IMPROVING THE RESISTANCE OF ARTICLES OF STEEL TO H-INDUCED STRESS-CORROSION CRACKING

[75] Inventors: Ingo von Hagen, Krefeld; Gerd Heinz, Merrbusch-Strümp; Rolf K. Pöpperling, Mülheim; Hubertus Schlerkmann, Roetgen, all of Fed. Rep. of Germany

[73] Assignee: Mannesmann Aktiengesellschaft, Düsseldorf, Fed. Rep. of Germany

[21] Appl. No.: 713,804

[22] Filed: Jun. 12, 1991

[51] Int. Cl.[5] ..... C21D 8/00

[52] U.S. Cl. ..... 148/651; 148/334

[58] Field of Search ..... 148/12 R, 12 B, 12 F

[56] References Cited

U.S. PATENT DOCUMENTS

| | | | |
|---|---|---|---|
| 3,830,669 | 8/1974 | Matsuoka et al. | 148/12 F |
| 3,947,293 | 3/1976 | Takechi et al. | 148/12 F |
| 4,105,474 | 8/1978 | Nakasugi et al. | 148/12 F |

FOREIGN PATENT DOCUMENTS

| | | | |
|---|---|---|---|
| 259027 | 10/1988 | Japan | 148/12 F |

*Primary Examiner*—R. Dean
*Assistant Examiner*—Sikyin Ip
*Attorney, Agent, or Firm*—Cohen, Pontani, Lieberman & Pavane

[57] ABSTRACT

A method of improving the resistance to H-induced stress-corrosion cracking of articles of low- to medium-alloy structural steels which come into contact with aqueous $H_2S$-containing fluids and which are manufactured by one of (i) hot rolling, with or without subsequent heat treatment, (ii) by TM-rolling, with or without accelerated cooling, and (iii) by cold rolling with subsequent heat treatment and which are then cold strained from 0% to less than 2%. In order to economically increase the resistance of articles of structural steel to H-induced stress-corrosion cracking, the articles are subjected to a final annealing for a period of at least two seconds at a temperature which is at least 540° C. and the upper limit of which is as follows: In the case of hot rolled or TM-rolled or normalized articles, 30K below $A_{C1}$; in the case of hardened and tempered articles, 30K below the tempering temperature last employed.

13 Claims, No Drawings

METHOD OF IMPROVING THE RESISTANCE OF ARTICLES OF STEEL TO H-INDUCED STRESS-CORROSION CRACKING

FIELD OF THE INVENTION

The present invention relates generally to a method of improving the resistance of articles of low- to medium-alloy structural steels to H-induced stress-corrosion cracking.

BACKGROUND OF THE INVENTION

Resistance to H-induced stress-corrosion cracking is required, in particular, in the case of steel pipes which are to be used under acid gas conditions and which, therefore, may come into contact with $H_2S$-containing fluids. Assuring sufficient resistance requires considerable expense in the manufacturing process. It is generally known that, in particular, the following factors of influence tend to have a positive effect on the resistance to stress-corrosion cracking:

(i) a structure of the material which is as homogeneous as possible;

(ii) the least possible segregations in the material;

(iii) high fineness of grain;

(iv) as little as possible or no strain hardening;

(v) the least possible internal stress.

Due to the negative effects of strain hardening on the resistance to stress-corrosion cracking, it is generally required for steel pipes which are to be resistant to acid gas pursuant to the pertinent technical rules, such as API-5CT or NACE MR-01-75, that after cold straining there be effected a stress relief heat treatment as a result of which the values present before the strain hardening are again obtained. Various methods can be used in order to test the resistance of steel pipes to H-induced stress-corrosion cracking.

For instance, in accordance with Method D of NACE-Standard TMO177-90, the test is carried out on prestressed specimens in aqueous $H_2S$-containing test solutions, in which test a specific minimum value of the critical fracture toughness $K_{ISCC}$ must be reached. A customary value for oil field pipes of grade C90, for instance, is $$K_{ISCC} \geqq 30\ ksi\sqrt{in.}$$

The required values could, to be sure, also be still obtained at corresponding expense with the traditional methods of manufacture with due consideration of the above-indicated factors of influence. Nevertheless, it is desirable further to increase the values obtainable up to now in order to be able to offer even greater certainty both in production (risk of rejects) and in the use of such pipes.

SUMMARY OF THE INVENTION

An object of the present invention is, accordingly, to further increase the resistance of articles of structural steel to H-induced stress-corrosion cracking with measures involving only a slight expense.

The foregoing object is achieved in accordance with the invention by a method of improving the resistance to H-induced stress cracking corrosion of a low- to medium-alloy structural steel article that comes into contact with aqueous $H_2S$-containing fluids and is manufactured by a process selected from the group consisting of (i) hot rolling, with or without subsequent heat treatment, (ii) TM-rolling, with or without accelerated cooling, and (iii) cold rolling followed by a tempering heat treatment at a tempering temperature and which is then cold strained to an extent from 0% to less than 2%. In the method, the steel articles are subjected to a final annealing for a period of at least two seconds at a temperature of at least 540° C. and no greater than 30 K. below $A_{C1}$ in the case of hot rolled or TM-rolled or normalized articles, or 30 K. below the tempering temperature in the case of hardened and heat tempered articles. Additionally, the invention provides hardened and tempered oil field and conduit pipes that are resistant to acid gas and made in accordance with the foregoing method.

DETAILED DESCRIPTION OF THE PREFERRED EMBODIMENTS

In order to solve the above problem, it was first of all attempted to obtain an improvement in the resistance to acid gas by a suitable change in the composition of the steel. For this purpose, the percentages of the alloy elements Cr, Mo and Mn as well as the microalloy elements Ti (in combination with B) and Nb were, in particular varied. These alloy modifications, however, did not result in the desired success. The attempts to obtain substantial improvements by varying the heat treatment were also unsuccessful. Finally, the attempt to reach the goal by a further increase in the fineness of the grain proved insufficient. It was, therefore, entirely surprising that a very substantial improvement of the resistance to H-induced stress-corrosion cracking of hot-rolled, normalized or heat-treated articles of low or medium alloy structural steels is obtained by annealing such as known, for instance, for the stress relief heat treatment of strain-hardened articles, i.e. by annealing above 540° C. There was in itself no reason for such a "stress relief heat treatment" since the articles treated had not been subjected previously to cold straining. Even assuming that internal stresses of unfavorable amount are still present, this effect would not have been expected upon examination for H-induced stress-corrosion cracking on very small specimens. The finding was also surprising that the desired effect is obtained after only a few seconds of heating—in various cases about two seconds is sufficient—and therefore after a period of treatment considerably shorter than the customary stress relief heat treatment (for instance, 30 minutes). It is essential that the temperature in this treatment be limited to an upper limit of at most 30 K. below $A_{c1}$ in the case of hot rolled or TM-rolled or normalized articles or a maximum of 30 K. below the last tempering temperature applied in the case of hardened and tempered articles.

An annealing temperature within the range of 580° to 640° C., and in particular of about 620° C., has proven very suitable for most structural steels of low- or medium-alloy content. The duration of the annealing treatment can, as a rule, be limited to clearly less than two minutes and frequently to about 5 to 20 seconds. Longer annealing times do not result in any further increase in the resistance to H-induced stress-corrosion cracking.

The method of the invention is suitable in principle also for the production of sheets and sections; it can be used to particular advantage for the manufacture of hardened and tempered oil-field and conduit pipes that are resistant to acid gas since, in this case, no expensive equipment is necessary for such manufacture. Although inductive heating is preferred, the heat treatment can also be effected in a heating furnace, which, as a general rule, is part of the customary equipment of a pipe mill. The necessary expenditure of energy is also low due to the relatively low temperatures and the short time of treatment so that the additional production expenses are minor and are compensated for by the reduction in the percentage of rejects.

The efficiency of the method of the invention will be explained further on the basis of the following example.

A seamless oil field pipe of grade C90 consisting of 29 Cr Mo 4 4 steel was produced in known manner by hot rolling followed by hardening and tempering. The material has the following analysis:

| | |
|---|---|
| 0.29% | C |
| 0.27% | Si |
| 0.96% | Mn |
| 0.012% | P |
| 0.002% | S |
| 0.05% | Al |
| 1.01% | Cr |
| 0.42% | Mo |
| Balance iron and ordinary impurities | |

A critical fracture toughness of $$K_{ISCC} = 30.6\ ksi\sqrt{in}$$

was found on samples of this pipe upon examining their resistance to H-induced stress-corrosion cracking.

By way of comparison, a steel pipe of the same material produced in the same way was subjected, after heat treatment in accordance with the invention, to a final inductive heating at 620° C. for a period of 5 seconds and then cooled in air. Upon subsequently examining specimens of this pipe, a value of the critical fracture toughness of $$K_{ISCC} = 34.9\ ksi\sqrt{in}$$

was found. This considerable improvement over the comparison value was obtained by only the brief heat treatment and, therefore, at an extremely small additional expense.

It should be understood that the preferred embodiments and examples described are for illustrative purposes only and are not to be construed as limiting the scope of the present invention which is properly delineated only in the appended claims.

We claim:

1. A method of improving the resistance to H-induced stress cracking corrosion of low- to medium-alloy structural steel articles that come into contact with aqueous $H_2S$-containing fluids and that are manufactured by a process selected from the group consisting of (i) hot rolling, with subsequent heat treatment, (ii) TM-rolling, with or without accelerated cooling, and (iii) cold rolling followed by a tempering heat treatment at a tempering temperature, the method consisting essentially of:

subjecting the articles to a final annealing for a period of at least two seconds up to two minutes at a temperature of at least 540° C. and no greater than 30 K. below $A_{c1}$.

2. The method according to claim 1, wherein the annealing time is 5 to 20 seconds.

3. The method according to claim 1, wherein the annealing temperature lies within the range of 580° to 640° C.

4. The method according to claim 1, wherein the annealing temperature lies within the range of 580° to 640° C.

5. The method according to claim 2, wherein the annealing temperature lies within the range of 580° to 640° C.

6. The method according to claim 3, wherein the annealing temperature is 620° C.

7. A hardened and tempered one of an oil field and conduit pipe of low- to medium-alloy steel having improved resistance to H-induced stress corrosion cracking by a final treatment in accordance with the method of claim 1.

8. A hardened and tempered one of an oil field and conduit pipe of low- to medium-alloy steel having improved resistance to H-induced stress corrosion cracking by a final treatment in accordance with the method of claim 1.

9. A hardened and tempered one of an oil field and conduit pipe of low- to medium-alloy steel having improved resistance to H-induced stress corrosion cracking by a final treatment in accordance with the method of claim 2.

10. A hardened and tempered one of an oil field and conduit pipe of low- to medium-alloy steel having improved resistance to H-induced stress corrosion cracking by a final treatment in accordance with the method of claim 4.

11. A hardened and tempered one of an oil field and conduit pipe of low- to medium-alloy steel having improved resistance to H-induced stress corrosion cracking by a final treatment in accordance with the method of claim 4.

12. A hardened and tempered one of an oil field and conduit pipe of low- to medium-alloy steel having improved resistance to H-induced stress corrosion cracking by a final treatment in accordance with the method of claim 5.

13. A hardened and tempered one of an oil field and conduit pipe of low- to medium-alloy steel having improved resistance to H-induced stress corrosion cracking by a final treatment in accordance with the method of claim 6.

* * * * *